US009375819B2

(12) United States Patent
Edwards

(10) Patent No.: US 9,375,819 B2
(45) Date of Patent: Jun. 28, 2016

(54) BOUND BLOCK OF DETACHABLE SHEETS AND MANUFACTURE METHOD THEREFOR

(76) Inventor: Robert Edwards, Netanya (IL)

( * ) Notice: Subject to any disclaimer, the term of this patent is extended or adjusted under 35 U.S.C. 154(b) by 1172 days.

(21) Appl. No.: 13/372,547

(22) Filed: Feb. 14, 2012

(65) Prior Publication Data

US 2012/0217734 A1 Aug. 30, 2012

Related U.S. Application Data

(60) Provisional application No. 61/446,063, filed on Feb. 24, 2011.

(51) Int. Cl.

| | |
|---|---|
| ***B42B 5/06*** | (2006.01) |
| ***B24B 5/06*** | (2006.01) |
| ***B42C 9/00*** | (2006.01) |
| ***B42C 19/02*** | (2006.01) |
| ***B42D 1/02*** | (2006.01) |
| ***B42D 5/00*** | (2006.01) |
| ***B42F 1/02*** | (2006.01) |

(52) U.S. Cl.

CPC ..... *B24B 5/06* (2013.01); *B42C 9/0056* (2013.01); *B42C 19/02* (2013.01); *B42D 1/02* (2013.01); *B42D 5/00* (2013.01); *B42F 1/02* (2013.01)

(58) Field of Classification Search

CPC ..... B42C 3/00; B42C 1/12; B42C 9/02; B42C 19/02; B42C 9/0056; B42D 5/00; B42D 5/003; B42D 5/02; B42D 5/021; B42D 5/023; B42D 5/027; B42D 5/028; B42D 5/06; B42D 1/02; B42D 1/04; B42D 1/06; B42D 1/10; B42B 5/06

See application file for complete search history.

(56) References Cited

U.S. PATENT DOCUMENTS

| | | | | |
|---|---|---|---|---|
| 1,570,099 | A | 1/1926 | Taylor | |
| 2,591,351 | A | 5/1949 | Gray | |
| 2,956,674 | A | 10/1960 | Weilby | |
| 3,284,102 | A * | 11/1966 | Sack | 281/21.1 |
| 4,244,069 | A | 1/1981 | Hale | |
| 4,420,282 | A | 12/1983 | Axelrod | |
| 5,112,083 | A | 5/1992 | Morrone | |
| 6,322,867 | B1 * | 11/2001 | Rush et al. | 428/40.1 |
| 6,726,423 | B2 * | 4/2004 | Hocking | 412/1 |
| 7,246,981 | B2 * | 7/2007 | Parker | 412/8 |
| 2006/0061089 | A1 * | 3/2006 | Arlook | 283/56 |

FOREIGN PATENT DOCUMENTS

| | | |
|---|---|---|
| GB | 2377670 | 1/2003 |
| JP | 58166479 U | 11/1983 |
| JP | 3091353 U | 1/2003 |
| WO PCT/US2007/002729 | | 10/2007 |

* cited by examiner

*Primary Examiner* — Matthew G Katcoff

(74) *Attorney, Agent, or Firm* — Daniel J. Swirsky; AlphaPatent Associates Ltd.

(57) ABSTRACT

A bound block of detachable sheets is disclosed, including a plurality of individual sheets, the edges of which are aligned, where the individual sheets are bound to a binding sheet, which is furnished with an adhesive, where the butt-edges of the individual sheets are adherent to the binding sheet, forming the block, and where a bracket is introduced onto the bound block, effectively restricting the bound block from over-opening.

6 Claims, 3 Drawing Sheets

Fig.1
Prior Art
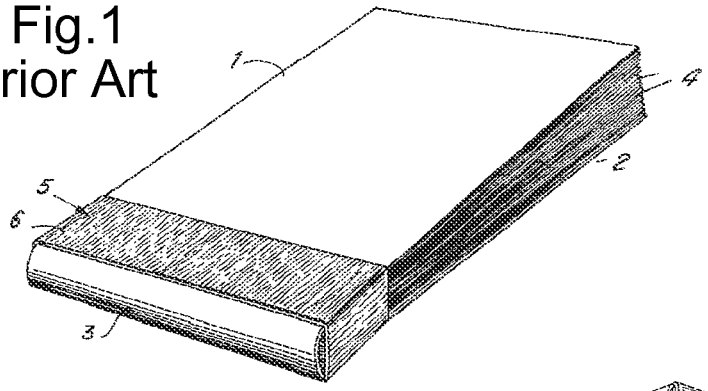
Fig.2
Prior Art
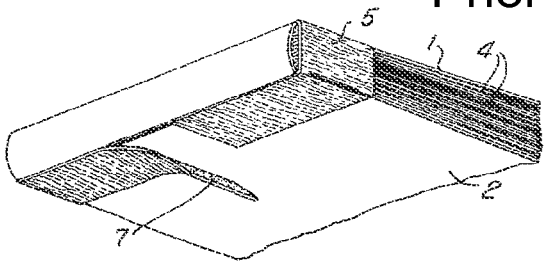
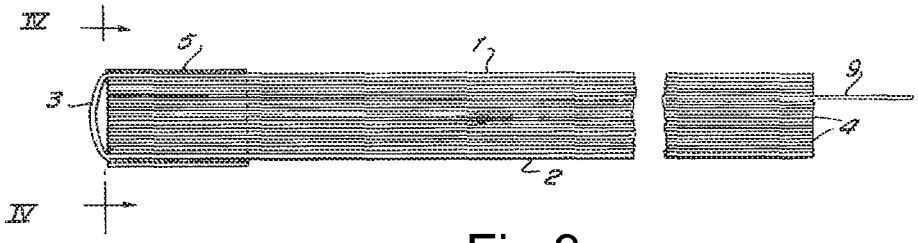
Fig.3
Prior Art

BOUND BLOCK OF DETACHABLE SHEETS AND MANUFACTURE METHOD THEREFOR

CROSS-REFERENCE TO RELATED APPLICATIONS

This application claims priority benefit of U.S. Provisional Patent Application No. 61/446,063, filed Feb. 24, 2011, the contents of which are incorporated herein by reference in their entirety.

FIELD OF THE INVENTION

In general, the present invention pertains to the arts of paper and sheets binding. In particular, the invention relates to a bound block with detachable sheets and a method of manufacturing the same.

BACKGROUND OF THE INVENTION

It is believed that the pertinent state-of-the-art is represented by: U.S. Pat. Nos. 1,570,099, 4,420,282, 2,956,674, 2,591,351, 5,112,083 and 4,244,069; GB patent Ser. No. 2377670; Japanese patent/application Ser. No. 2005289422, 3091353U and 58166479U as well as by international patent applications having publication No. WO2007097890.

GB2377670 discloses a notepad using two glues to hold the pages together, the first being a weak adhesive, possibly polyvinyl acetate, to hold the pages together as a bundle and a second very high bond pressure sensitive adhesive, e.g. acrylic, on both sides of a strip of a foam, in the form of a tape, that holds the bundle to the foam and the foam to the spine of the covers. This combination of spine, foam, and two adhesives allows the individual pages to be removed with less tearing of the edges and without the notebook falling apart.

U.S. Pat. No. 5,112,083 discloses a paper pad securement clip for use with a paper pad having a plurality of paper sheet members and optionally including a backing member. The paper pad of U.S. Pat. No. 5,112,083 presents a base surface and an upper surface with the individual sheet members edge glued together. The paper securement clip of U.S. Pat. No. 5,112,083 has a base member secured with respect to the lower end and an upper member secured with respect to the upper end. The base member includes a base member end and a first obliquely angled tip member. A first abutment surface is defined thereon also. The upper member defines an upper member end and a second obliquely angled tip having a second abutment surface. The first and second abutment surfaces are operative to secure the individual paper sheet members of the paper pad together with respect to one another and facilitate removal of individual sheets therefrom. The pad securement device optionally includes a removal arm extending outwardly therefrom defining a cutting edge thereon. A display area may also be defined on the upper surface of the upper member of the pad securement clip to facilitate display of appropriate information thereon.

Use of certain types of adhesives is known in the art in the context of binding sheets. It is noted however that adhesives can be classified into hardening and non-hardening types. Hardening adhesives are typically either reactive adhesives that chemically react to harden, e.g. epoxy glues, adhesives that harden by drying, such as various volatile solvent based adhesives, or thermoplastic adhesives, such as hot melt adhesive (HMA). The common to hardening adhesives is their tendency to undergo a reaction, whether chemical or physical, whether reversible or not, whereby their physical state is altered as they harden and lose their resiliency. Frequently upon hardening such adhesives loose their adhesive properties, towards new objects, which haven't previously engaged to the adhesive.

The use of hardening types of adhesives is known in the art in the context of binding sheets. The use of non-hardening types of adhesives however is very non-common and even contra-intuitive in the context of binding sheets, since the binding force of non-hardening adhesives is typically week to effectively bind the block together whilst their residues on the sheets are further considered as suboptimal for many applications.

U.S. Pat. No. 2,956,674 discloses a binding for flat articles such as envelopes, calling cards, IBM cards, order blanks, installment payment card records, and other similar flat articles, which are desired to be bound collectively but removed intact, without tearing or mutilation.

In view of the foregoing, publications in the art of paper and sheets binding disclose various methods and techniques of reducing tearing and mutilation of the edges of detached sheets. Therefore any improvements to such methods of reducing tearing and mutilation shall entail a utilitarian benefit.

BRIEF DESCRIPTION OF THE DRAWINGS

The present invention will be understood and appreciated more comprehensively from the following detailed description taken in conjunction with the appended drawings in which:

FIGS. 1, 2, and 3 are representations of a prior art, namely U.S. Pat. No. 2,956,674, method of engaging articles in a package;

Figure 4A:
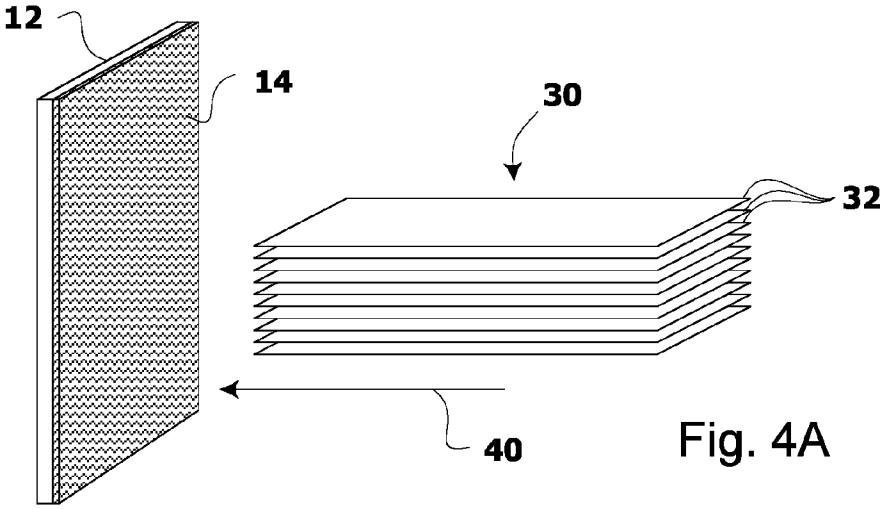
FIG. 4A is a schematic diagram illustrating a step of the binding process of the present invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

Figure 5A:
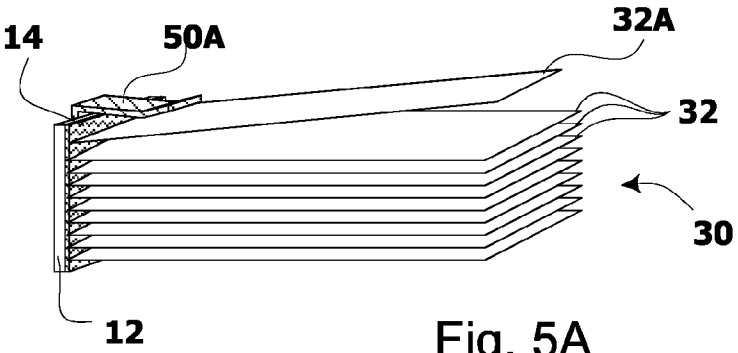
FIG. 5A is a perspective view of an embodiment of the bound block, showing the implementation of a bracket.
Figure 5B:
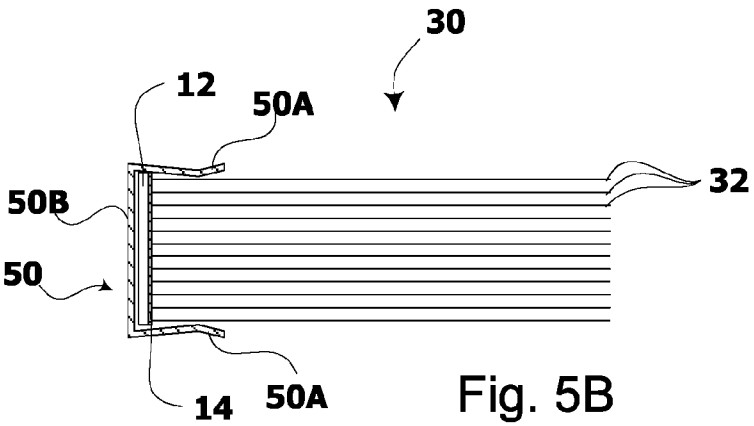
FIG. 5B is a side view of an embodiment of the bound block illustrated in FIG. 5A, showing the implementation of a bracket.
Figure 5C:
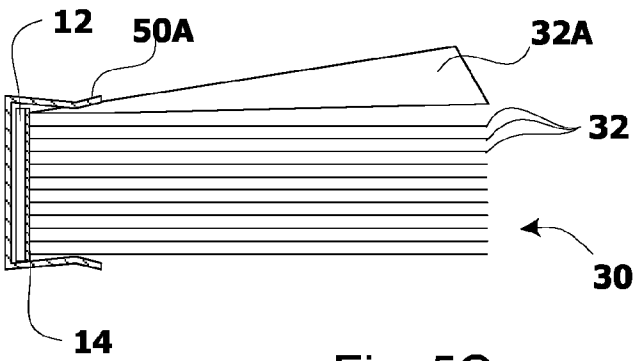
FIG. 5C is a side view of an embodiment of the bound block illustrated in FIG. 5A, showing the limitation imposed by the bracket.
Figure 5D:
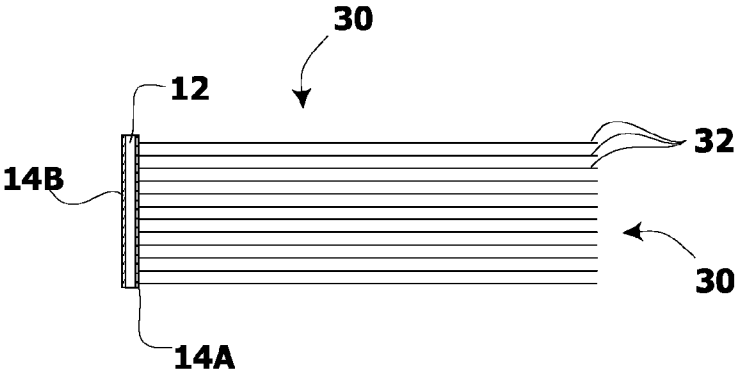
FIG. 5D is a side view of a preferred embodiment of the bound block, showing the implementation of a binding sheet covered with adhesive on both sides.

The term adhesive as referred to herein and particularly adhesive 14B, shown in FIG. 5D, facing individual sheets 32 to bind them together, is to be construed as including particularly non-hardening types of adhesives, forming a relatively weak bonds and retaining a resilient physical state over time.

In accordance with some embodiments of the present invention, reference is now made to FIG. 4A, schematically illustrating the binding process of the method of the present invention. Binding sheet 12 is typically an essentially plane and flexible sheet, used to bind the individually detachable sheets of the bound block of the invention, as will be elaborated infra. Binding sheet 12 typically comprises a polymeric, textile as well as other woven or extruded plane sheet, and preferably an absorbent tissue paper or fine lightweight paper, particular examples of which include double sided adhesive sheet Catalogue Number AK11 TNT available from ROZDOR TRADING CO. INC, at Ha'Yarden St' 13, Yavne 81228 Israel. Binding sheet 12 is furnished with adhesive 14, on at least one side thereof. Preferable examples of adhesive 14 inter alia include double sided adhesive sheet Catalogue Number AK11 TNT available from ROZDOR TRADING CO. INC, at Ha'Yarden St' 13, Yavne 81228 Israel. The characteristic physical properties of the double sided adhesive sheet AK11 TNT from ROZDOR TRADING is that the adhesive thereon is of a non-hardening type, forming relatively weak bonds and retaining a resilient physical state over time.

Sheet block 30 comprises a plurality of individual sheets 32, which are piled-up so that the edges thereof are aligned, forming a substantially rectangular parallelepiped structure. Sheets 32 are typically articles complying with relatively high finishing and/or aesthetic quality standards. Examples of such articles in a non-limiting manner include: business cards, postcards, mailing-cards, lettercards, greeting cards, etc. Articles with relatively high finishing and/or aesthetic quality standards, bound into a block, require a reduction/elimination of tearing and mutilation of the edges of individual articles detached from the block binding.

Figure 4B:
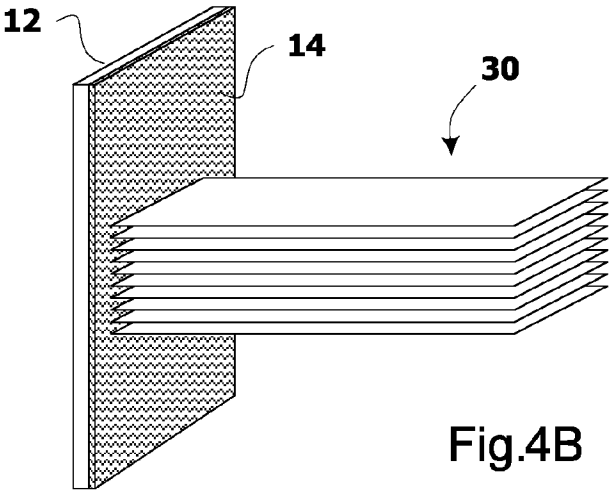
FIG. 4B is an isometric view of the intermediate product resulting the binding step illustrated in FIG. 4A.

Sheet block 30 is forced in the direction of arrow 40 vis-à-vis adhesive 14 furnishing binding sheet 12. Consequently the butt-edges of individual sheets 32 adhere to binding sheet 12, so that the face rectangular parallelepiped structure forming block 30 is bound by adhesive 14 to binding sheet 12; essentially as shown in FIG. 4B, reference to which is now made.

Figure 4C:
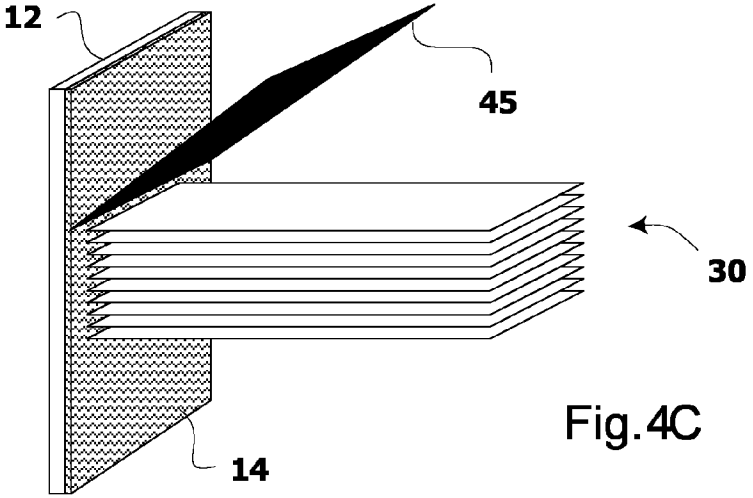
FIG. 4C is a schematic diagram illustrating the step of chamfering the intermediate product shown in FIG. 4B in accordance with an embodiment of the method of the present invention.

Thereafter, the excesses binding sheet 12 are removed, typically as shown in FIG. 4C, reference to which is now made. Blades, such as blade 45, capable of cutting through binding sheet 12 are appended to binding sheet 12 adjacently and in parallel to the edges of the face of block 30 adherent to binding sheet 12. A force is then exerted onto blade 45, urging it to cut throughout binding sheet 12; thereby chamfering the excessive portions of sheet 12. The procedure is repeated for all edges of the face of block 30 adherent to binding sheet 12. Eventually, the process of chamfering results block 30, shown in FIG. 4D reference to which is now made, comprising a plurality of individual sheets 32, bound to binding sheet 12, without excessive portions of the latter. An individual sheet of sheets 32, such as sheet 32A, is removable from block 30 by sheet 32A lifting and pulling sheet 32A away from binding sheet 12 detaching the butt-edge sheet 32A from adhesive 14 to binding sheet 12. Noticeably, the butt-edge of individual sheets, such as sheet 32A, detached from adhesive 14 of binding sheet 12 is virtually absent of any visible tearing or mutilation marks as well as of any signs of adhesive, to the naked eye; thereby rendering individually detached sheets applicable for articles with relatively high finishing and/or aesthetic quality standards.

It is emphasized however that the binding of a block of sheets, such as block 30, to a binding sheet covered with an adhesive, such as binding sheet 12 covered with adhesive 14, provides relatively fragilely bound block; whereby the integrity of the binding is easily disrupted by merely over-opening the block. In attempt to address this drawback, a peripheral confining strip of tape is used in the art, namely in U.S. Pat. No. 2,956,674, the contents of which are incorporated herein by reference, and particularly in FIGS. 1 to 3, to which reference is now made. In U.S. Pat. No. 2,956,674 this strip of tape is stretched about the inner end of package to exert a compressive force to the ends of the articles engaged therebetween. However the usage of a strip or tape stretched about the inner end of the package and exerting a compressive force to the ends of the articles, as in U.S. Pat. No. 2,956,674, is a suboptimal solution for overcoming the aforementioned inherent problem resulting the binding by the means of an adhesive sheet, namely a fragilely bound block the integrity of which is easily disrupted by merely over-opening, i.e. opening the block to an obtuse angle, due to the at least three following reasons;

1. Upon removal of a substantial portion of the sheets from the contents of the block, the strip of tape stretched about the inner end of the block fails to efficiently preserve the integrity of the block's binding; thus the remaining portion of the bound sheets tends to disintegrate form the binding;
2. If forcefully over-opening the block in the middle of the package, the strip of tape stretched about the inner end of the package fails to efficiently preserve the integrity of the block's binding, whereas the implementation of a bracket, as elaborated immediately hereunder, causes the detachment of single sheet from the middle of the package, at the site of opening, whilst efficiently preserving the integrity of the remaining sheets' binding in the block;
3. The strip of tape stretched about the inner end of the package is apparent and thus is suboptimal for bound blocks with relatively high finishing and/or aesthetic quality standards, wherein appearance of the block itself is important; thus a package with a strip of tape is suitable for calling cards, IBM cards, order blanks, installment payment card records, as in U.S. Pat. No. 2,956,674, wherein the appearance of the block itself is unimportant but rather the appearance of the article does matter, whereas the implementation of a bracket, as elaborated immediately hereunder, renders the bound block of the invention suitable for applications with relatively high finishing and/or aesthetic quality standards of the block itself, e.g. bound blocks of postcards, mailing-cards, lettercards, greeting cards and particularly business cards.

In accordance with some preferred embodiments of the present invention, reference is now made to FIGS. 5A to 5C, showing the implementation of bracket 50, to overcome the above-specified problems characterizing the implementation of a strip of tape. Bracket 50 comprises flanking portions 50A and backbone portion 50B. Flanking portions 50A extend from backbone portion 50B of bracket 50, on the top and bottom of block 30 and substantially paralleling thereto; whereas backbone portion 50B extends along the opposite side of binding sheet 12 than the side covered by adhesive 14 facing block 30. Flanking portions 50A extend on the top and bottom from the face of block 30 from about 5% to about 15% from length of block 30.

Flanking portions 50A effectively restrict the opening of block 30 to acute angles and prevents over-opening of block 30, i.e. opening the block 30 to an obtuse angle; thereby facilitating preserving the integrity of the binding of sheets 32 from block 30 to binding sheet 12. Flanking portions 50A preferably embody a structured shape; wherein a major portion thereof extending from backbone portion 50B of bracket 50 is somewhat slanted, being oriented towards block 30, whereas the terminal portions thereof is somewhat slanted, being away from block 30. It is emphasized that flanking portions 50A of bracket 50 do not exert any positive compressive force on sheets 32 to from block 30, as oppose to the strip of tape in U.S. Pat. No. 2,956,674 stretched about the inner end of package to exert a compressive force to the ends of the articles engaged therebetween. The fact that Since flanking portions 50A of bracket 50 do not exert any positive compressive force on sheets 32 renders sheets 32 are applicable for articles of relatively high finishing and/or aesthetic quality standards, such as business cards and postcards, since flanking portions 50A of bracket 50 do not leave or impress any pressure or friction marks on the surface of sheets 32 upon detachment of the same from block 30.

Figure 4D:
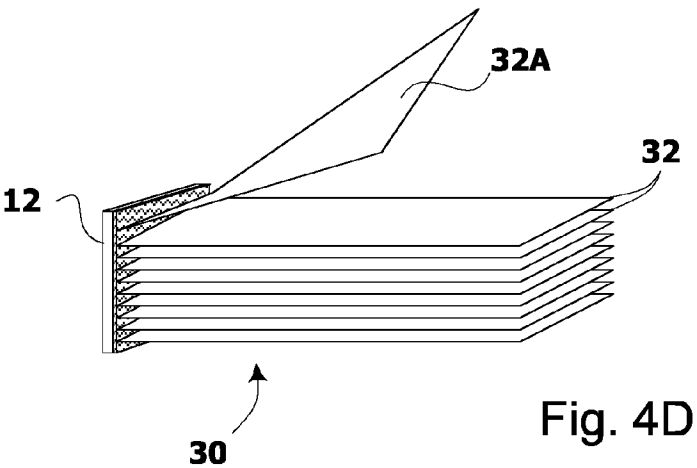
FIG. 4D is an isometric view of an embodiment of the product resulting the chamfering step illustrated in FIG. 4C.

After binding sheets 32 of block 30, by adhesive 14 to binding sheet 12 and chamfering the excessive portions thereof, essentially as shown in FIGS. 4A to 4C, the resultant bound block 30, as shown in FIG. 4D, is introduced into bracket 50. The width of bracket 50 is preferably somewhat from about 10% to 40% of the width of block 30. Bracket 50 is preferably centralized along the opposite side of binding sheet 12 than the side facing block 30. Therefore, in order to facilitate the attachment of bracket 50 to the side of binding sheet 12 facing away from block 30, sheet 12 is preferably furnished with adhesives on both sides thereof, as shown in FIG. 5D, to which reference is now made. Binding sheet 12 is furnished with adhesives 14A and 14B, respectively on the side facing block 30 and on the side facing away from block 30. Adhesive 14A faces block 30 and binding sheets 32 thereto; whereas adhesive 14B facilitates the attachment of bound block 30, to the interior face of backbone portion 50B of bracket 50 facing block 30; thereby retains bracket 50 attached to the binding sheet 12 of bound block 30.

It is further emphasized that that since sheets 32 according to the present invention are detached absent of any tear or mutilation marks on the edges of the detached sheets, sheets 32 are applicable for articles with relatively high finishing and/or aesthetic quality standards, such as business cards and postcards.

It will be appreciated by persons skilled in the art that the present invention is not limited by what has been particularly shown and described herein above. Rather the scope of the invention is defined by the claims which follow:

The invention claimed is:

1. A method of manufacturing a bound block of detachable sheets, said method comprising the steps of:

[a] providing a sheet block, wherein said block comprising a plurality of individual sheets;

[b] aligning the edges of said sheets, whereby said block assumes a substantially rectangular parallelepiped structure;

[c] providing a binding sheet, wherein said at least one side of said binding sheet is furnished with an adhesive;

[d] forcing said block towards said adhesive on said binding sheet; whereby the butt-edges of said individual sheets adhere to said binding sheet, so that a face of said rectangular parallelepiped structure, which forms said block, is bound by said adhesive to said binding sheet;

[e] removing excessive portions of said binding sheet, by chamfering said binding sheet with blades, essentially in parallel to the edges of said face of said rectangular parallelepiped structure, which forms said block, and

[f] introducing the resultant bound block into a bracket, wherein said bracket comprises flanking portions extending on top and bottom of said block essentially paralleling to said block, wherein said bracket effectively restricts said bound block from over-opening, wherein said flanking portions of said bracket do not exert any compressive force onto said sheets, wherein said individual sheets are detachable from said binding sheet essentially absent of any tear or mutilation marks on edges of detached sheets, thereby rendering said individual sheets compliant with quality standards which require absence of said tear or mutilation marks, and wherein the flanking portions of said bracket effectively restrict the opening of said block to acute angles and prevent over-opening of said block to an obtuse angle, thereby facilitating preserving the integrity of the binding of said sheets from said block to said binding sheet.

2. The method as set forth in claim 1, wherein said individual sheets are detachable from said binding sheet.

3. The method as set forth in claim 1, wherein said individual sheets are detachable from said binding so that the butt-edge thereof is virtually absent of any visible tearing or mutilation marks and/or any signs of said adhesive.

4. The method as set forth in claim 1, wherein said individual sheets are reattachable to said binding sheet form a butt-edge thereof.

5. The method as set forth in claim 1, wherein the flanking portions of said bracket extend from about 5% to about 15% of length of said block.

6. The method as set forth in claim 1, wherein the flanking portions of said bracket embody a structured shape characterized by that proximal portions thereof are slightly slanted oriented towards said block, whereas the terminal portions thereof are slightly slanted oriented away from block.

* * * * *